US008012055B2

(12) United States Patent
Hagfors et al.

(10) Patent No.: US 8,012,055 B2
(45) Date of Patent: Sep. 6, 2011

(54) PRESS BELT

(75) Inventors: Satu Hagfors, Ylojarvi (FI); Olli Jermo, Tampere (FI); Marita A. Leppimaki, legal representative, Tampere (FI)

(73) Assignee: Tamfelt PMC Oy, Tampere (FI)

( * ) Notice: Subject to any disclaimer, the term of this patent is extended or adjusted under 35 U.S.C. 154(b) by 349 days.

(21) Appl. No.: 10/587,148

(22) PCT Filed: Feb. 2, 2005

(86) PCT No.: PCT/FI2005/000071

§ 371 (c)(1),
(2), (4) Date: Apr. 9, 2007

(87) PCT Pub. No.: WO2005/075734

PCT Pub. Date: Aug. 18, 2005

(65) Prior Publication Data

US 2007/0243964 A1 Oct. 18, 2007

(30) Foreign Application Priority Data

Feb. 3, 2004 (FI) ..... 20040166

(51) Int. Cl.
*D21F 3/02* (2006.01)
*F16G 1/08* (2006.01)

(52) U.S. Cl. ..... 474/260; 474/261; 162/358.4; 162/901

(58) Field of Classification Search ..... 474/260, 474/261, 268; 162/358.4, 901
See application file for complete search history.

(56) References Cited

U.S. PATENT DOCUMENTS

| | | | | |
|---|---|---|---|---|
| 4,238,287 | A | 12/1980 | Gill | |
| 4,555,241 | A * | 11/1985 | Takano et al. | 474/261 |
| 5,134,010 | A | 7/1992 | Schiel | |
| 5,238,537 | A | 8/1993 | Dutt | |
| 5,259,822 | A * | 11/1993 | Nakanishi et al. | 474/263 |
| 5,624,338 | A * | 4/1997 | Kawashima et al. | 474/263 |
| 6,284,102 | B1 * | 9/2001 | Inoue et al. | 162/358.4 |
| 6,331,341 | B1 | 12/2001 | Joyce | |
| 6,908,532 | B2 * | 6/2005 | Steiner et al. | 162/358.4 |
| 7,185,757 | B2 * | 3/2007 | Ishino et al. | 198/847 |
| 2003/0148687 | A1 | 8/2003 | Korfer et al. | |
| 2003/0232557 | A1 | 12/2003 | Korfer | |
| 2004/0029669 | A1 * | 2/2004 | Phely | 474/202 |

FOREIGN PATENT DOCUMENTS

| | | |
|---|---|---|
| EP | 0038276 A1 | 10/1981 |
| EP | 1 055 773 A2 | 11/2000 |
| GB | 2 332 916 A | 7/1999 |
| JP | A 07-056651 | 3/1995 |

* cited by examiner

*Primary Examiner* — Robert Siconolfi
*Assistant Examiner* — Anna Momper
(74) *Attorney, Agent, or Firm* — Oliff & Berridge, PLC

(57) ABSTRACT

The invention relates to a press belt (1) made from an elastomer material and forming a closed loop, the belt having an inner surface (2) and an outer surface (3) and three layers of reinforcement yarns (7', 5', 6') arranged inside the elastomer material. In the invention, an outermost yarn layer (7) is formed by longitudinal and transversely adjacent reinforcement yarns (7') of the press belt (1), which absorb energy and are restored from deformation with delay in connection with deformation.

9 Claims, 2 Drawing Sheets

PRESS BELT

BACKGROUND OF THE INVENTION

The invention relates to a press belt made from an elastomer material and forming a closed loop, the belt having an inner surface and an outer surface and three layers of reinforcement yarns arranged inside the elastomer material, an innermost yarn layer closest to the inner surface being formed by longitudinal and transversely adjacent reinforcement yarns of the press belt, and a middle yarn layer being formed by transverse longitudinally adjacent reinforcement yarns of the press belt.

Press belts are employed in various presses associated with papermaking, particularly in shoe-type presses between the paper machine fabric and the shoe press or the roll in order to constitute a surface for lengthening the press section of the press.

Known press belts typically comprise a belt containing an elastomer material, such as polyurethane or rubber, the inside of the belt comprising a supporting structure composed of yarns. The supporting structure may be a fabric or composed of separate yarn layers superimposed transversely relative to each other. Such solutions are known from U.S. Pat. Nos. 4,238,287, 5,134,010 and 5,238,537, and Japanese patent 0,756,651, for example.

When in use, press felts are subjected to quite hard stresses because of both the compression and particularly the bending that takes place in different directions in the press section. With time, these stresses may cause cracks in the actual belt material, which gradually cause the belt to be damaged unusable. When belts are used, sometimes randomly generated paper accumulations cause sudden extensive deformation forces when passing through the press, which may break or damage the press belt.

BRIEF DESCRIPTION OF THE INVENTION

The object of the present invention is to provide a press belt allowing cracks to be reduced and, on the other hand, allowing their propagation to be prevented and thus the service life of the belt to be lengthened.

The press belt of the invention is characterized in that an outermost yarn layer closest to the outer surface of the press belt is formed by longitudinal and transversely adjacent reinforcement yarns of the press belt, which absorb energy and are restored from deformation with delay in connection with deformation.

The essential idea of the invention is that closest to the surface of the press belt on the side of the web is located a separate yarn layer longitudinal to the press belt and composed of yarns made from an elastic material absorbing the energy consumed by the deformation, the layer yielding and stretching as the belt bends thus enabling an abrupt bending on the one hand, but, on the other hand, being restored from deformation with delay substantially to its original form binding part of the energy consumed by the deformation in a manner preventing the elastomer material from getting damaged and preventing an existing breakage from propagating significantly.

An advantage of the press belt of the invention is that after cracks are formed, their propagation is stopped or significantly slowed down at the flexible yarn layer, which, however, does not essentially stiffen the press belt, but enables sufficiently abrupt bending and sudden deformations.

BRIEF DESCRIPTION OF THE FIGURES

The invention will be described in more detailed in the attached drawings, wherein FIG. 1 schematically shows a perspective view of a press belt forming a closed loop.

DETAILED DESCRIPTION OF THE INVENTION

Figure 1:
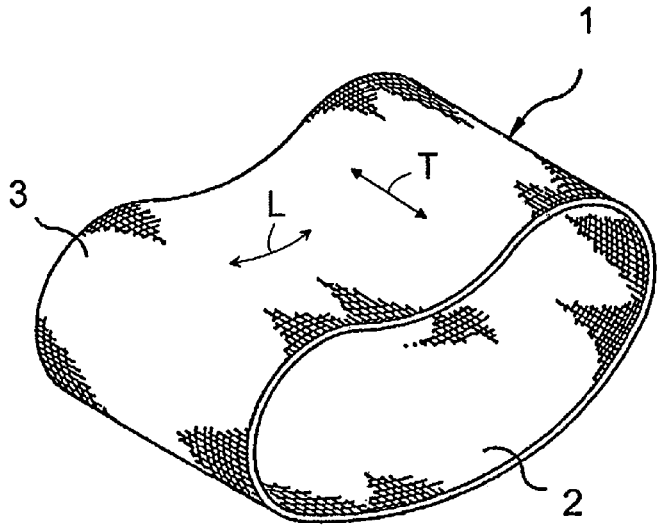

FIG. 1 schematically shows a press belt forming a closed loop. The press belt comprises inner and outer surfaces. The press belt is made from an elastic material allowing it to bend in its longitudinal direction at the required radius of curvature in both directions in a manner enabling its passage through a shoe press, for example, which is schematically shown in connection with FIG. 6.

Figure 2:
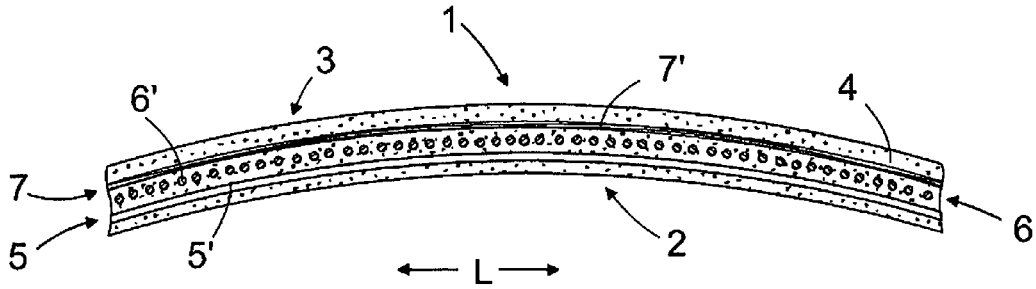
FIG. 2 is a schematic sectional view of a press belt of the invention in its longitudinal direction.

FIG. 2 shows a partial cross-section of a press belt in its longitudinal direction. It shows the actual press belt material, made from an elastomer material. This material may be for instance of rubber or an artificial material, such as polyurethane or the like, having sufficient flexibility and resilience properties in view of the usage conditions and requirements of the press belt. Furthermore, it shows a press belt supporting structure composed of three yarn layers 5 to 7 formed by superimposed yarns. The innermost longitudinal yarn layer 5 of the press belt is composed of either a plurality of adjacent yarns 5' in the transverse direction of the press belt or of one or more adjacent spiral-like yarns 5' arranged in the transverse direction of the press belt. It further comprises a middle layer 6 composed of adjacent yarns 6' transverse to the press belt in its longitudinal direction. These yarn layers 5, 6 do not necessarily have to be fastened to each other or bound to each other in any way, although it is naturally possible. Furthermore, FIG. 2 shows a third yarn layer 7 composed of yarns 7' in the longitudinal direction of the press belt. These yarns 7' are adjacent separate yarns in the transverse direction of the press belt 1 or they are composed of one or more adjacent yarns 7' arranged spiral-like in the transverse direction of the press belt 1.

The yarns 5' and 6' of the inner yarn layers 5, 6 are typically monofilaments or multifilaments made from polyamide, polypropylene, polyethylene, aramid, polyvinyl alcohol or some other suitable plastic material. The material and/or structure of the yarns 7' of the outermost yarn layer 7, in turn, are more flexible than at least the yarns 6' of the middle layer 6. Thus, they may absorb energy into their structure during deformation in a manner allowing them to be restored with delay from their deformation. The outermost yarns 7' are preferably multifilament yarns, which are either stranded or twisted at a high twist level in a manner known per se. Their material may be for instance a polyamide elastane mixture, polyester or a mixture thereof or polyester that is treated to become flexible. It is essential that the yarns 7' yield and thus stretch in their longitudinal direction when the press belt is bent such that its outer surface 3 has to stretch.

Figure 3:
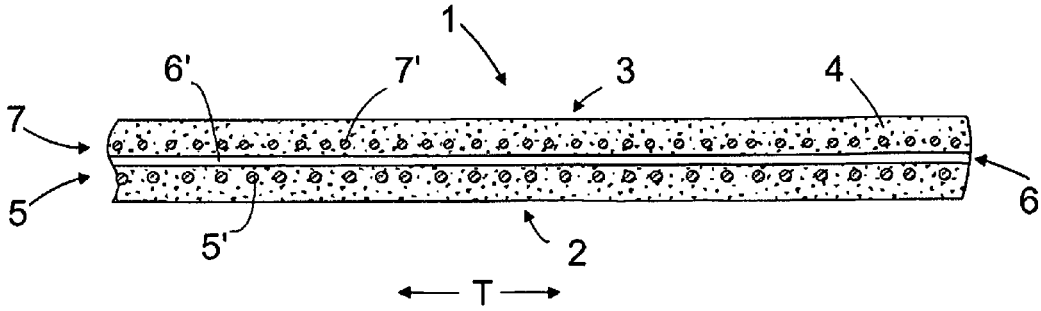
FIG. 3 is a schematic sectional view of a press belt of the invention in its transverse direction.

FIG. 3 schematically shows a cross-section of the press belt 1 according to FIG. 1 in its transverse direction. It shows how separate yarns or the yarns 7' of one or more adjacent spirals are arranged adjacent to each other at a distance from each other in such a manner that the belt material 4 is settled around the yarns 7'. It also shows how the transverse yarns 6' are arranged above the innermost yarns 5', for instance at a small distance from them. Furthermore, the separate yarns 7' or one or more spiral-like twisted yarns 7' are arranged above the middlemost yarns 6'. The outermost yarns 7' may be either in contact with the middlemost yarns 6' or, as FIG. 3 shows, at a distance from them. The yarns 7' are preferably multifilament yarns suitably stranded or twisted, most preferably at a high twist level. Furthermore, the yarns 7' may be of the same thickness as the innermost and middlemost yarns 5' and 6', but preferably they are somewhat thinner than the latter. The innermost yarns 5' and the middlemost yarns 6' may also be of a different thickness, whereby the innermost yarns 5' may be thinner than the middlemost yarns 6'. If the reinforcement yarns 5', 6' of some inner yarn layer 5, 6 are multifilament yarns, the reinforcement yarns 7' of the outermost yarn layer 7 are preferably twisted at a higher twist level than the former. In some cases it is feasible for the yarns 5' of the innermost yarn layer 5 to be more flexible than the yarns 7' of the outermost yarn layer 7.

Figure 4:
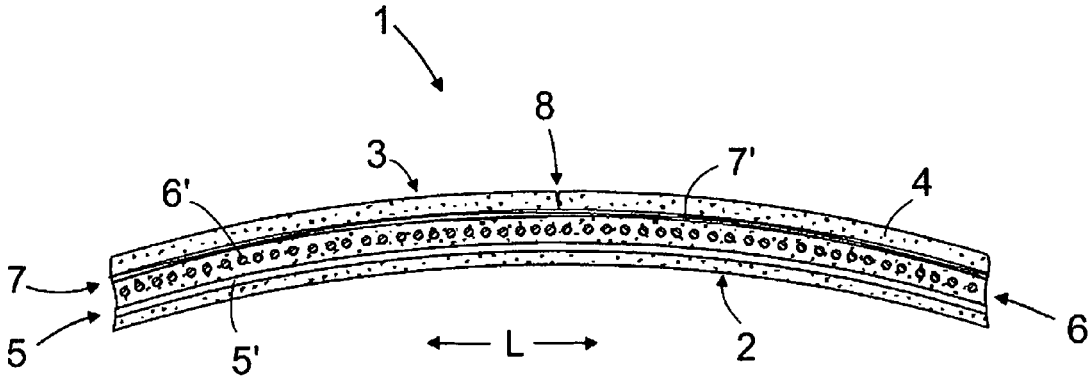
FIG. 4 is a schematic sectional view of a press belt according the invention, having a cracked surface, in its longitudinal direction.

FIG. 4 is a sectional side view in the longitudinal direction of a press belt at a point where a transverse crack 8 has been formed on its outer surface 3. The crack 8 extends from the outer surface 3 downward up to the outermost longitudinal yarns 7' of the press belt 1. At this point, the yarns 7' support the press belt material 4 and impair the propagation of the crack 8 towards the inner surface 2 of the press belt 1. Accordingly, the propagation of the crack 8 is slowed down, and the damaging of the press belt 1 to unusable is delayed, which lengthens the service life of the press belt in spite of the generation of cracks.

Figure 5:
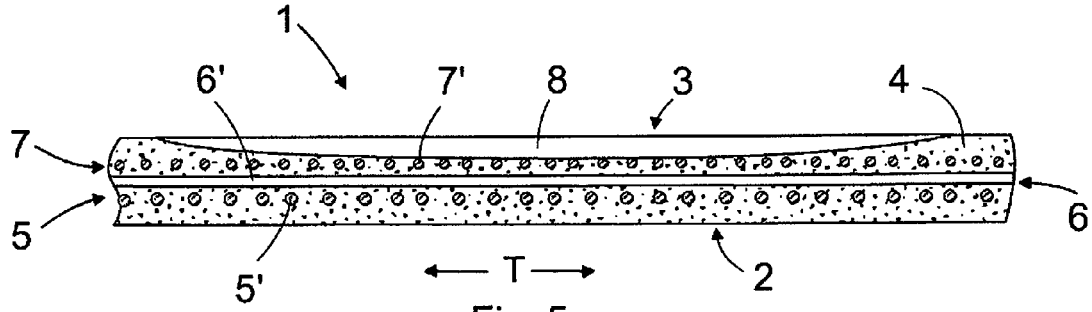
FIG. 5 is a schematic sectional view of a press belt of the invention in its transverse direction at a crack, and FIG. 6 schematically shows a shoe press in which the press belt of the invention is usable.

FIG. 5 is a sectional view of the press belt of FIG. 4 in the direction of the crack 8. It shows how the crack 8 is formed in the press belt 1 and propagated broader in its longitudinal direction and, at the same time, along the main part of the stretch up to the yarns 7'. From hereon forward, its propagation is slower as the yarns 7' support the belt material 4, thus allowing the press belt to be used for even a long time in spite of the crack.

Figure 6:
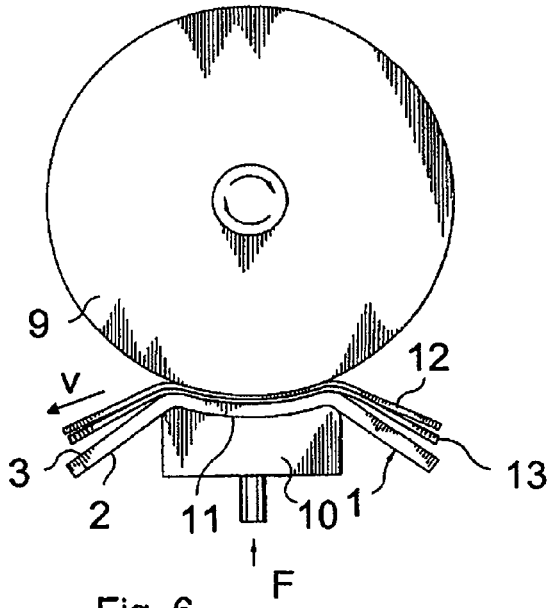

FIG. 6 shows the press belt in a typical drying apparatus, i.e. a shoe press. The shoe press comprises a roll 9. A press shoe 10 is pushed with force F against the roll, the press belt 1 and a fibre web 12 between the press belt and the roll 9 travelling along an arched surface 11 of the press shoe in the direction of arrow V. The fibre web 12 is arranged against the roll 9 and the press belt 1 glides along the surface 11 of the press shoe 10. One or more paper machine fabrics, such as felts or wires 13, are also arrange between the roll 9 and the fibre web 12. It is exactly in such a shoe press that the press belt 1 is subjected to high stresses when having to bend quite abruptly with a small radius at the edges of the shoe 10 of the shoe press.

In the foregoing description and drawings, the invention has been described only by way of example, and it is by no means to be so restricted. The yarn layers can be generated when making the press belt in a plurality of manners known per se, and the press belt per se can be made in manners known per se. It is essential that the material and/or structure of the longitudinal, outermost yarns, i.e. those closest to the surface of the press belt on the side of the fibre web are flexible, more flexible than the other longitudinal yarns and preferably multifilament yarns stranded or twisted to generate a suitable, flexible and durable structure. Accordingly, the filaments of the multifilament yarns of the outermost yarn layer may be somewhat thinner than the filaments of the multifilament yarns of some inner yarn layer, the outermost yarn layer may comprise less filaments, the material in the outermost yarn layer may be more flexible than that of the inner yarn layers etc.

The invention claimed is:

1. A press belt made from an elastomer material and forming a closed loop in a longitudinal direction, a transverse direction being perpendicular to the longitudinal direction, the belt having an inner surface and an outer surface and three layers of reinforcement yarns arranged inside the elastomer material, an innermost yarn layer closest to the inner surface extending in the longitudinal direction and having adjacent reinforcement yarns spaced in the transverse direction, a middle yarn layer extending in the transverse direction and having adjacent reinforcement yarns spaced in the longitudinal direction, and an outermost yarn layer closest to the outer surface of the press belt extending in the longitudinal direction and having adjacent reinforcement yarns spaced in the transverse direction, which absorb energy and are restored from deformation with delay in connection with deformation, wherein the material and/or structure of the reinforcement yarns of the outermost yarn layer are more flexible than the reinforcement yarns of the innermost yarn layer and middle yarn layer in such a manner that in connection with deformation of the press belt they absorb more energy and are restored from the deformation more slowly than the yarns of the other yarn layers.

2. A press belt as claimed in claim 1, wherein the material and/or structure of the reinforcement yarns of the outermost yarn layer are more flexible than the reinforcement yarns of the middle yarn layer.

3. A press belt as claimed in claim 1, wherein the reinforcement yarns of the outermost yarn layer are multifilament yarns twisted at a twist level.

4. A press belt as claimed in claim 1, wherein the reinforcement yarns of at least one innermost yarn layer and middle yarn layer are multifilament yarns, the reinforcement yarns of the outermost yarn layer are twisted at a higher twist level than the former.

5. A press belt as claimed in claim 1, wherein the outer yarn layer is composed of a plurality of mutually parallel separate reinforcement yarns.

6. A press belt as claimed in claim 1, wherein the outermost yarn layer is composed of one or more adjacent reinforcement yarns twisted spiral-like in the transverse direction of the press belt.

7. A press belt as claimed in claim 1, wherein at least a part of the innermost yarn layer and middle yarn layer is composed of a plurality of mutually parallel separate reinforcement yarns in the same layer.

8. A press belt as claimed in claim 1, wherein the innermost yarn layer is composed of one or more spiral-like adjacent reinforcement yarns twisted in the transverse direction of the press belt.

9. A press belt as claimed in claim 1, wherein the press belt is for a press associated with paper making.

* * * * *